United States Patent [19]

Honda et al.

[11] Patent Number: 4,799,470

[45] Date of Patent: Jan. 24, 1989

[54] SUPPORTING STRUCTURE FOR AIR-CLEANED ASSEMBLY

[75] Inventors: Minoru Honda, Obu; Toshiaki Fukuta, Nagoya; Akihide Yamaguchi, Kariya; Kenzi Ikuta, Hekinan, all of Japan

[73] Assignee: Nippondenso Co., Ltd., Kariya, Japan

[21] Appl. No.: 106,517

[22] Filed: Oct. 9, 1987

[30] Foreign Application Priority Data

Oct. 13, 1986 [JP] Japan ..... 61-241556

[51] Int. Cl.[4] ..... F02M 39/00

[52] U.S. Cl. ..... 123/470; 123/198 E; 123/52 M

[58] Field of Search ..... 123/472, 470, 52 M, 123/198 E; 261/DIG. 67

[56] References Cited

U.S. PATENT DOCUMENTS

| | | | |
|---|---|---|---|
| 3,521,726 | 7/1970 | Freyn | 123/198 E |
| 4,241,702 | 12/1980 | Takeuchi | 123/198 E |
| 4,373,491 | 2/1983 | Knapp | 123/472 |
| 4,694,797 | 9/1987 | Hamai | 123/470 |
| 4,726,328 | 2/1988 | Takeda | 123/52 M |

FOREIGN PATENT DOCUMENTS

| | | | |
|---|---|---|---|
| 3141290 | 4/1983 | Fed. Rep. of Germany | 123/470 |
| 0014830 | 2/1981 | Japan | 123/467 |
| 0045770 | 3/1985 | Japan | 123/198 E |
| 0175759 | 9/1985 | Japan | 123/198 E |
| 0160533 | 7/1986 | Japan | 123/198 E |
| 0226557 | 10/1986 | Japan | 123/198 E |

*Primary Examiner*—Carl Stuart Miller

*Attorney, Agent, or Firm*—Cushman, Darby & Cushman

[57] ABSTRACT

A supporting structure for supporting an air-cleaner assembly on a throttle body of an internal combustion engine provided with a fuel injector arranged at a center of an intake passage. A bridge member has at least two legs. The leg has one end fixed to the throttle body and the other end extending radially inwardly toward a central axis of the intake passage formed in the throttle body. The other ends of the legs are joined to each other at a joining portion. The joining portion is abutted against an end of the fuel injector opposite to a fuel injection port thereof. A fixing device cooperates with the bridge member to fix the air-cleaner assembly with respect to the throttle body.

4 Claims, 4 Drawing Sheets

SUPPORTING STRUCTURE FOR AIR-CLEANED ASSEMBLY

FIELD OF THE INVENTION AND RELATED ART STATEMENT

The present invention relates to a supporting structure for an air-cleaner assembly for use in internal combustion engines and, more particularly, to a structure for supporting an air-cleaner assembly on a throttle body provided with a fuel injector.

In a conventional structure for mounting an air-cleaner assembly to a carburetor of an internal combustion engine, a support bolt is provided at a center of an intake passage and along the central axis thereof. The air-cleaner assembly is mounted on the carburetor in such a manner that the support bolt passes through an attaching bore formed at a center of the air-cleaner assembly. A butterfly nut is threadedly engaged with the support bolt and is tightened to support the air-cleaner assembly on the carburetor.

However, some difficulty is encountered in application of the above-described conventional supporting structure to an internal combustion engine of SPI (Single Point Injection) type in which a fuel injector is provided at the center of the intake passage formed in the throttle body, as disclosed in Japanese Utility Model Laid-Open Application No. 58-129068. Specifically, when the air-cleaner assembly is mounted to the engine of SPI type, it is difficult to dispose the support bolt along the central axis of the intake passage in the throttle body, because the fuel injector is provided at the center of the intake passage.

By the reason described above, the arrangement of the conventional SPI type engine is such tat the intake passage is formed in eccentric relation to the central axis of the throttle body, as will be described later in detail. In the arrangement of another SPI type engine, the air-cleaner assembly is mounted to the throttle body by means of bolts provided at a flange of the throttle body such that the central axis of the throttle body is coincident with the intake passage, as will also be described later in detail.

With the former arrangement, however, it is necessary to form a thickened peripheral wall portion on the throttle body. Thus, the throttle body increases in size as compared with another one in which the intake passage of the same size is formed. This results in a problem of an increase in occupied space, weight and cost.

With the latter arrangement, such a problem arises that the number of parts and the number of assembling steps increase. Another problem arises that it is impossible for the latter arrangement to sufficiently increase the size of the filter element as compared with another one which employs an air-cleaner assembly of the same outline size. The arrangement also has a problem of an increase in flow passage resistance.

OBJECT AND SUMMARY OF THE INVENTION

It is an object of the invention to provide a supporting structure for an air-cleaner assembly, which can solve the above-discussed problems.

To this end, an arrangement of the invention is such that a bridge member is provided which has at least two legs. The legs have their respective one ends fixed to a throttle body and the respective other ends extending radially inwardly toward a central axis of an intake passage formed in the throttle body. The respective other ends of the legs are joined to each other at a joining portion. A fixing member is provided which projects from the joining portion for fixing an air-cleaner assembly to the throttle body.

According to the invention, the bridge member has the joining portion from which the fixing member projects. Thus, it is possible to fix the air-cleaner assembly to the throttle body by the fixing member, whereby the above-discussed problems can be solved.

The above and other objects, features and advantages of the invention will become apparent from the ensuing detailed description in conjunction with the accompanying drawings.

DETAILED DESCRIPTION OF THE PREFERRED EMBODIMENTS

Figure 2:
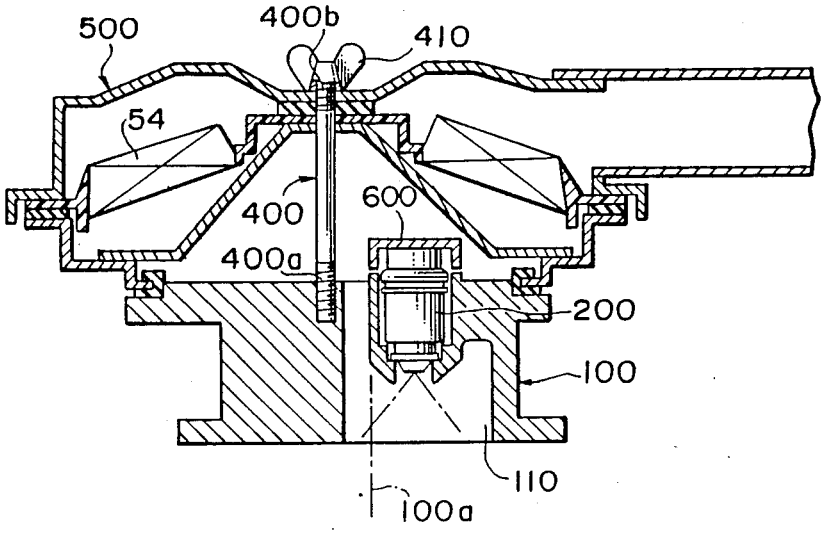
FIG. 2 PRIOR ART
FIGS. 2 and 3 are cross-sectional views respectively showing the conventional arrangements.

In the conventional internal combustion engine of SPI type, as shown in FIG. 2, an intake passage 110 is formed in eccentric relation to a central axis 100*a* of a throttle body 100. A fuel injector 200 is arranged at center of the intake passage 110. A support bolt 400 having opposite threaded ends 400*a* and 400*b* is provided in the throttle body 100, into a thickened peripheral wall portion of which one 400*a* of the threaded ends is screwed, such that the support bolt 400 projects from the thickened peripheral wall portion. An air-cleaner assembly 500 incorporating therein a filter element 54 is mounted on the throttle body 100 in such a manner that the support bolt 400 passes through an attaching bore provided at a center of the air-cleaner assembly 500. A butterfly nut 410 is threadedly engaged with the other threaded end 400*b* to clamp and support the air-cleaner assembly 500 on the throttle body 100.

Figure 3:
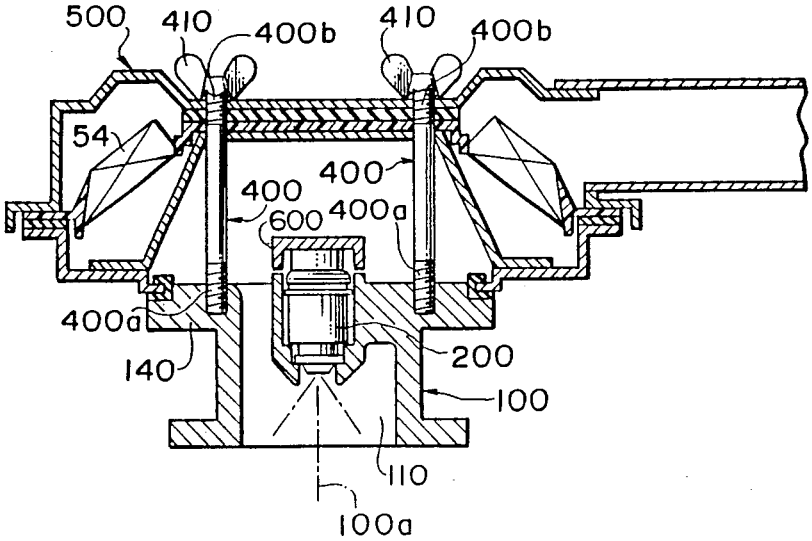
FIG. 3 PRIOR ART

In another internal combustion engine of SPI type, as shown in FIG. 3, the intake passage 110 is formed in concentric relation to the central axis 100*a* of the throttle body 100. The fuel injector 200 is arranged at the center of the intake passage 110. Two support bolts 400 each having opposite threaded ends 400*a* and 400*b* are provided in the flange 140 of the throttle body 100, into which threaded ends 400*a* are screwed, such that the support bolts 400 project in spaced relation to each other from the flange 140. The air-cleaner assembly 500 incorporating therein a filter element 54 is mounted on the throttle body 100 in such a manner that the support bolts 400 and 400 pass respectively through two spaced attaching bores formed in the air-cleaner assembly 500. Butterfly nuts 410 and 410 are threadedly engaged respectively with the threaded ends 400*b* of the respective support bolts 400 to clamp and support the air-cleaner assembly 500 on the throttle body 100.

The arrangements illustrated in FIGS. 2 and 3 have various problems described previously.

Figure 1:
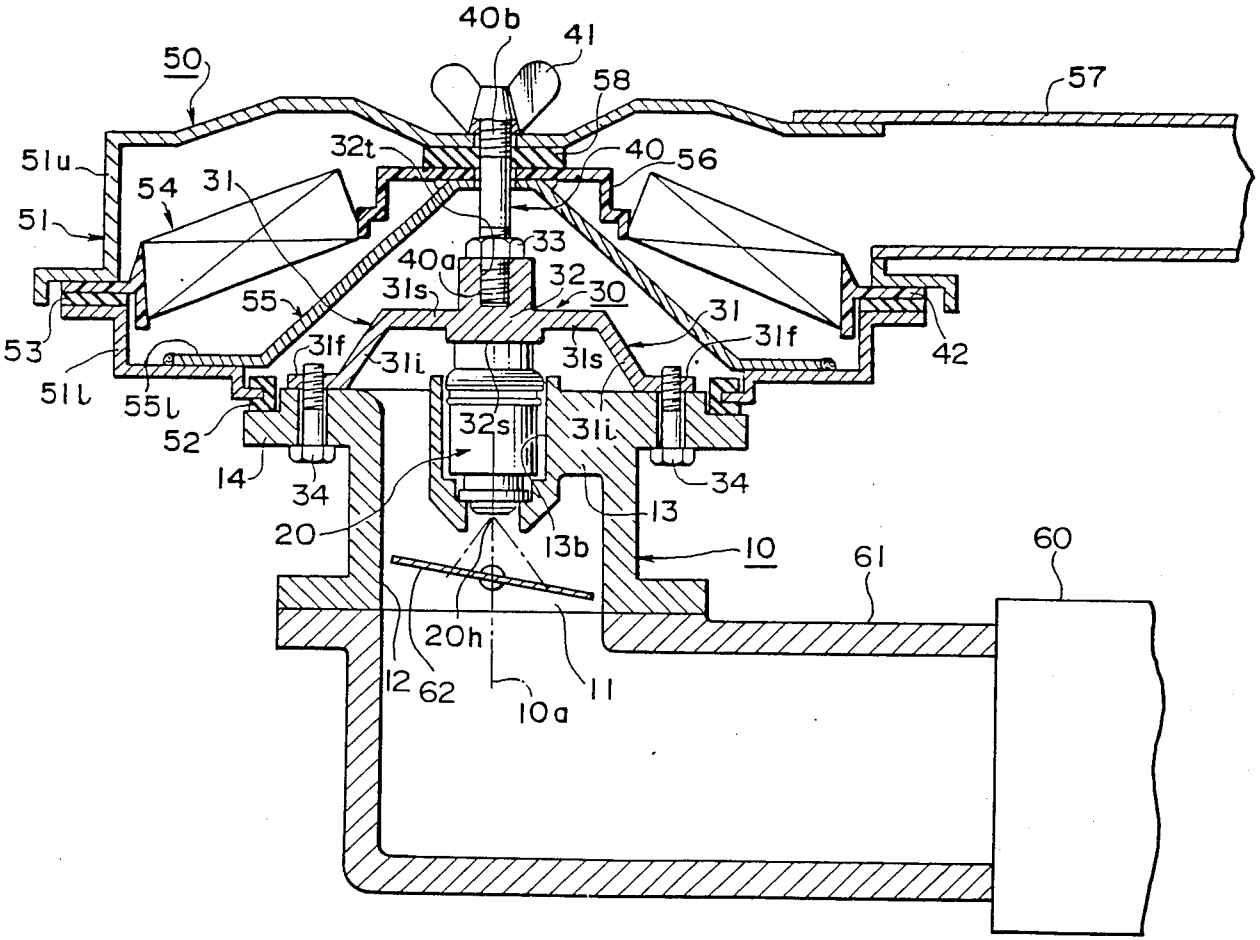
FIG. 1 is a cross-sectional view showing a supporting structure according to an embodiment of the invention.

In order to solve these problems, an arrangement of the preferred embodiment of the invention is, as shown in FIG. 1, such that an intake passage 11 is formed in a throttle body 10 in concentric relation to a central axis 10*a* thereof. The intake passage 11 communicates with a collecting portion of an intake manifold 61 of an internal combustion engine 60. The throttle body 10 has an inner peripheral wall surface 12, a portion 13 of which projects diametrically inwards through the central axis 10*a*. The projecting portion 13 is provided with a stepped bore 13*b* for retaining a fuel injector 20, at such a location that the axis of the fuel injector 20 is aligned with the central axis 10*a*. A peripheral edge of the fuel injector 20 is seated on a shoulder of the bore 13*b* so that the fuel injector 20 is positioned and retained. A throttle valve 62 is provided for angular movement at a location immediately below the fuel injector 20 within the intake passage 11.

Figure 4:
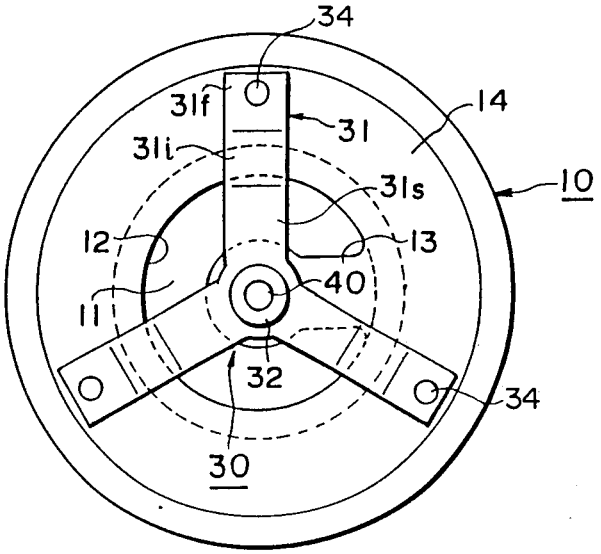
FIG. 4 is a top plan view of the arrangement illustrated in FIG. 1, with an air-cleaner assembly removed.

The throttle body 10 has an annular flange 14 on which mounted is an aluminum bridge member 30 integrally molded by die casting. As clearly seen from FIG. 4, the bridge member 30 is provided with three legs 31 each of which is comprised of a first flat portion 31*f*, a second flat portion 31*s* provided in offset relation to the first flat portion 31*f* and an intermediate portion 31*i* connecting both flat portions to each other. The leg 31 is fixed at one end or the flat portion 31*f* thereof to the annular flange 14 of the throttle body 10 by a bolt 34. The other end or the second flat portion 31*s* of the leg 31 extends radially inwardly toward the axis of the intake passage 11 which is coincident with the central axis 10*a*. The second flat portions 31*s* are integrated together into a joining portion 32. The joining portion 32 has one end face 32*s* which is abutted against an end face of the fuel injector 20 opposite to a fuel injection port 20*h* thereof.

A support bolt 40 having opposite threaded ends 40*a* and 40*b* projects from the joining portion 32 beyond the other end face thereof. The threaded end 40*a* of the support bolt 40 is threadedly engaged with a threaded bore 32*t* formed in the joining portion 32, and the support bolt 40 is fixed to the bridge member 30 by a lock nut 33.

Figure 5:
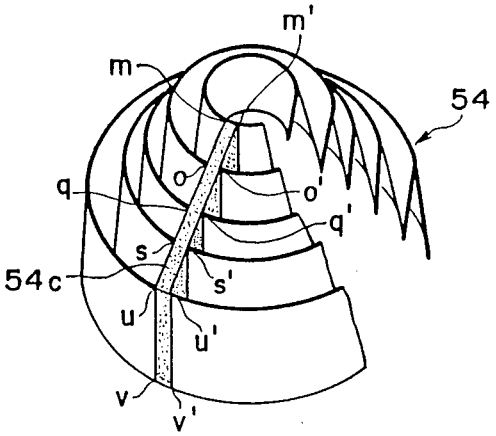
FIG. 5 is a perspective view showing a filter element illustrated in FIG. 1.
Figure 6:
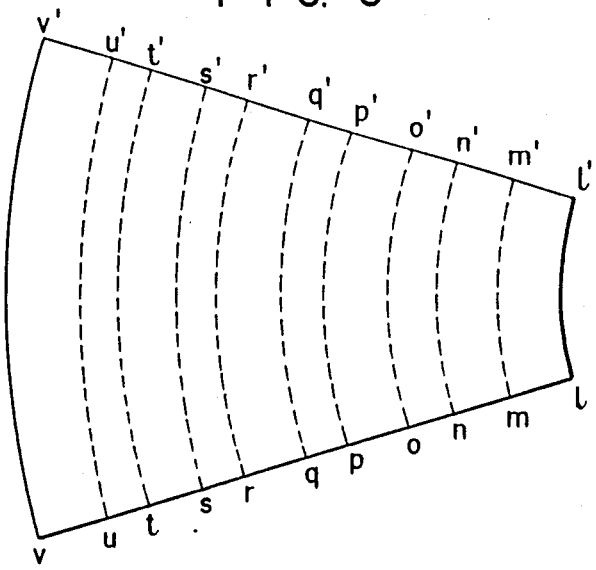
FIG. 6 is a developed view of a filter material forming the filter element shown in FIG. 5.

An air-cleaner assembly 50 is mounted on the throttle body 10 so as to surround the bridge member 30. The air-cleaner assembly 50 has a case 51 comprised of a lower case half 51*l* mounted on the throttle body 10 through a gasket 52 and an upper case half 51*u* fit with the lower case half 51*l* through a gasket 53, and an annular filter element 54 which is clamped at an outer peripheral edge thereof between the case halves 51*u* and 51*l*, so that the filter element 54 is retained in the position. The filter element 54 is formed by a single filter material sheet in the form of a sector, as shown in FIG. 6. The filter material sheet is folded back alternately in the opposite directions along the broken lines m–m' to u–u', and the opposite side edges l–v and l'–v' of the filter material sheet are joined to each other through a connecting portion 54*c* to form the annular frustoconical filter element 54 as shown in FIG. 5. The filter element 54 should not be limited to the illustrated one of axial flow type, but may be one of radial flow type of an annular structure in which a plurality of radial pleats are successively formed in the circumferential direction. Within the case 51, a first support member 55 is arranged, which is in the form of the inverted letter V in cross-section as shown in FIG. 1, and in the form of the letter I in plan. The first support member 55 has lower bent ends 55*l* which are welded to the lower case half 51*l*. A disc-shaped second support member 56 formed of resin is molded integrally with the inner peripheral edge of the filter element 54. Thus, by mounting the second support member 56 on the top of the first support member 55, the filter element 54 is supported on the first support member 55. In addition, a ring-shaped support frame 42 formed of resin is molded integrally with the outer peripheral edge of the filter element 54. The support frame 42 has a lower surface which is in contact with the gasket 53. The attaching bores aligned with each other are formed in the respective central portions of the upper case half 51*u*, the second support member 56 and the first support member 55. These members 51*u*, 56 and 55 are mounted, together with the lower case half 51*l*, on the fuel injector 20 in such a manner that the support bolt 40 passes through the attaching bores in the respective members 51*u*, 56 and 55. The reference numeral 41 denotes a butterfly nut which is threadedly engaged with the other threaded end 40*b* of the support bolt 40 to support the air-cleaner assembly 50 on the throttle boy 10. An inlet 57 is connected to the case 51 of the air-cleaner assembly 50 for introducing the outside air into the case 51. The air introduced through the inlet 57 is supplied to the intake passage 11 through the filter element 54. Sealing of the interior of the air-cleaner assembly 50 is maintained by the gaskets 52 and 53 and a gasket 58 interposed, under compression by the butterfly nut 41, between the upper case half 51*u* and the second support member 56.

Figure 7:
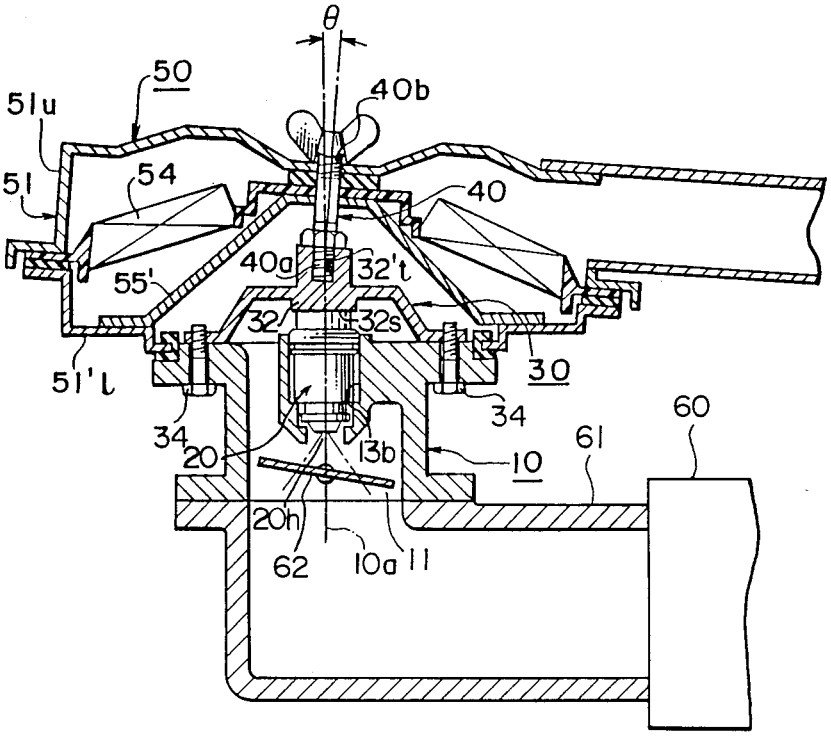
FIG. 7 is a view similar to FIG. 1, but showing another embodiment of the invention.

FIG. 7 shows another embodiment of the invention which is designed to be applied to such an arrangement that the air-cleaner assembly must be disposed in inclined relation to the axis of the intake passage, due to limitations of accommodation space and the like. In FIG. 7, parts or component like or similar to those of the embodiment shown in FIG. 1 are designated by the same reference numerals, and the description of such parts or components will therefore be omitted.

In the embodiment illustrated in FIG. 7, the air-cleaner assembly 50 is inclined at a certain angle $\theta$ with respect to the axis 10*a* of the intake passage 11, that is, the axis of the support bolt 40 inclines with respect to the axis 10*a*. The embodiment is different from the previous embodiment only in the first support member, the lower case half and the threaded bore formed in the joining portion. Specifically, the first support member 55' is not uniform in generatrix length over the entire circumference, unlike the previous embodiment. Further, the side wall of the lower case half 51'*l* is not uniform in height over the entire circumference. Moreover, the threaded bore 32'*t* is formed to have an axis inclined correspondingly to the angle of inclination $\theta$. Except for these component parts, all of other components employed in the previous embodiment can be utilized in the embodiment illustrated in FIG. 7. Thus, the embodiment of FIG. 7 is advantageous in the view point of the cost, and can enjoy advantages similar to those of the previous embodiment.

According to the invention, the one end face 32*s* of the joining portion 32 of the bridge injector 20 opposite to the injection port 20*h*. Thus, the fuel injector 20 is prevented from being ejected out of the stepped bore 13*b* under the pressure of the injected fuel. This makes it possible to eliminate the necessity of provision of a cap 600, as shown in FIGS. 2 and 3, for preventing the fuel injector from being ejected.

The two preferred embodiments of the invention have been described, but the invention should not be limited to these specific forms. For example, the bridge member 30 may be one manufactured by molding of resin or by press working of metal. Moreover, the legs and the joining portion separate from each other may be assembled with each other by welding or the like to form the bridge member. The legs may be two, or four or more in number. Fixing means for fixing the bridge member 30 to the throttle body 10 may include the staking, the welding and the like. Attaching means for attaching the support bolt 40 to the joining portion 32 of the bridge member 30 may include the force-fitting of the support bolt into the joining portion and the integral molding of both members, in addition to the threaded engagement.

What is claimed is:

1. A supporting structure for supporting an air-cleaner assembly on a throttle body of an internal combustion engine provided with a fuel injector arranged at a center of an intake passage formed in said throttle body, said supporting structure comprising:

a bridge member having a joining portion and at least two legs, each of said legs having one end fixed to said throttle body and the other end extending radially inwardly toward a central axis of said intake passage, the other ends of said legs being joined to each other at said joining portion, said joining portion being abutted against an end of said fuel injector opposite to a fuel injection port thereof; and fixing means cooperating with said bridge member for fixing said air-cleaner assembly with respect to said throttle body.

2. A supporting structure as defined in claim 1, wherein said fixing means comprises:

a first support member fixed to said throttle body;

a threaded member projecting from said joining portion of said bridge member and extending through said first support member;

a second support member retaining said air-cleaner assembly; and a threadedly engaging member cooperating with said threaded member for fixing said second support member to said throttle body.

3. A supporting structure as defined in claim 1, wherein said legs and said joining portion of said bridge member are formed integrally.

4. A supporting structure ad defined in claim 2, wherein said threaded member is disposed in inclined relation to an axis of said fuel injector.

* * * * *